US010290488B1

(12) United States Patent
Winarski

(10) Patent No.: US 10,290,488 B1
(45) Date of Patent: May 14, 2019

(54) NANO-GAS LIGHT SOURCES BASED ON GRAPHENE FOR DISPLAYS

(71) Applicant: Tyson York Winarski, Mountain View, CA (US)

(72) Inventor: Tyson York Winarski, Mountain View, CA (US)

( * ) Notice: Subject to any disclaimer, the term of this patent is extended or adjusted under 35 U.S.C. 154(b) by 10 days.

(21) Appl. No.: 15/861,980

(22) Filed: Jan. 4, 2018

Related U.S. Application Data

(63) Continuation-in-part of application No. 15/401,084, filed on Jan. 8, 2017, now Pat. No. 9,891,380.

(51) Int. Cl.

| | |
|---|---|
| ***H01J 61/06*** | (2006.01) |
| ***H01J 61/30*** | (2006.01) |
| ***H01J 61/36*** | (2006.01) |
| ***H05B 41/36*** | (2006.01) |
| *G09G 3/10* | (2006.01) |

(52) U.S. Cl.
CPC ..... *H01J 61/302* (2013.01); *H01J 61/06* (2013.01); *H01J 61/366* (2013.01); *H05B 41/36* (2013.01); *G09G 3/10* (2013.01); *G09G 2300/0426* (2013.01); *G09G 2300/0452* (2013.01)

(58) Field of Classification Search
CPC ..... H01J 61/30; H01J 61/302; H01J 61/366
See application file for complete search history.

(56) References Cited

U.S. PATENT DOCUMENTS

| | | | | |
|---|---|---|---|---|
| 9,372,299 | B1 * | 6/2016 | Yi | H01J 65/042 |
| 2010/0079070 | A1 * | 4/2010 | Browne | H01J 61/125 313/623 |
| 2011/0025188 | A1 * | 2/2011 | Yang | H01J 61/0672 313/497 |
| 2015/0255945 | A1 * | 9/2015 | Winarski | H01S 3/06716 372/6 |

* cited by examiner

*Primary Examiner* — Mariceli Santiago
(74) *Attorney, Agent, or Firm* — The Winarski Firm, PLLC

(57) ABSTRACT

A gas light source is disclosed where gas is contained within a graphene cylinder or graphene capsule. Electrodes extending into the graphene cylinder or capsule are stimulated by an electric voltage to emit light. Eight graphene cylinder light sources can be arranged into a seven-segment alphanumeric display having a decimal point. Different gases produce different colors of light. Three gas light sources having different gases can be arranged into an RGB pixel. An array of RGB pixels can be formed into a display.

20 Claims, 11 Drawing Sheets

NANO-GAS LIGHT SOURCES BASED ON GRAPHENE FOR DISPLAYS

BACKGROUND

Neon lighting is formed of brightly glowing, electrified glass tubes or bulbs that contain rarefied neon or other gases. Neon lights are a type of cold cathode gas-discharge light. A neon tube is a sealed glass tube with a metal electrode at each end, filled with one of a number of gases at low pressure. A high potential of several thousand volts applied to the electrodes ionizes the gas in the tube, causing it to emit colored light. The color of the light depends on the gas in the tube. Neon lights were named for neon, a noble gas which gives off a popular orange light, but other gases and chemicals are used to produce other colors, such as hydrogen (red), helium (yellow), carbon dioxide (white), and mercury (blue). Neon tubes can be fabricated in curving artistic shapes, to form letters or pictures. They are mainly used to make dramatic, multicolored glowing signage for advertising, called neon signs, which were popular from the 1920s to the 1950s.

The range of outer diameters for the glass tubing used in neon lighting is 9 to 25 mm; with standard electrical equipment, the tubes can be as long as 30 meters (98 ft). The pressure of the gas inside is in the range 3-20 Torr (0.4-3 kPa), which corresponds to a partial vacuum in the tubing. Noble gases, known for being chemically unreactive, produce vivid colors. Neon, in particular, gives off a bright glow. The other noble gases, argon, helium, xenon, and krypton, are also used to create bright, colorful signs and displays. Radon, the other noble gas, is radioactive and not used in signs.

The neon sign is an evolution of the earlier Geissler tube, which is an electrified glass tube containing a "rarefied" gas (the gas pressure in the tube is well below atmospheric pressure). When a voltage is applied to electrodes inserted through the glass, an electrical glow discharge results. Geissler tubes were quite popular in the late 19th century, and the different colors they emitted were characteristics of the gases within. They were, however, unsuitable for general lighting; the pressure of the gas inside typically declined in use. The direct predecessor of neon tube lighting was the Moore tube, which used nitrogen or carbon dioxide as the luminous gas and a patented mechanism for maintaining pressure; Moore tubes were sold for commercial lighting for a number of years in the early 1900s. The discovery of neon in 1898 by the British scientists William Ramsay and Morris W. Travers included the observation of a brilliant red glow in Geissler tubes. Travers wrote, "the blaze of crimson light from the tube told its own story and was a sight to dwell upon and never forget." Following neon's discovery, neon tubes were used as scientific instruments and novelties.

Neon tube signs are produced by the craft of bending glass tubing into shapes. A worker skilled in this craft is known as a glass bender, neon bender or tube bender. The neon tube is commonly made out of 4 or 5-foot long straight sticks of hollow glass sold by sign suppliers to neon shops worldwide, where they are manually assembled into individual custom designed and fabricated lamps.

Tubing in external diameters ranging from about 8-15 mm with a 1 mm wall thickness is most commonly used, although 6 mm tubing is now commercially available in colored glass tubes. The tube is heated in sections using several types of burners that are selected according to the amount of glass to be heated for each bend. These burners include ribbon, cannon, or crossfires, as well as a variety of gas torches. Ribbon burners are strips of fire that make the gradual bends, while crossfires are used to make sharp bends. The interior of the tubes may be coated with a thin phosphorescent powder coating, affixed to the interior wall of the tube by a binding material. The tube is filled with a purified gas mixture, and the gas ionized by a high voltage applied between the ends of the sealed tube through cold cathodes welded onto the ends. The color of the light emitted by the tube may be just that coming from the gas, or the light from the phosphor layer. Different phosphor-coated tubing sections may be butt welded together using glass working torches to form a single tube of varying colors, for effects such as a sign where each letter displays a different color letter within a single word.

"Neon" is used to denote the general type of lamp, but neon gas is only one of the types of tube gases principally used in commercial application. Pure neon gas is used to produce only about one-third of the colors (mostly shades of red and orange, and some warmer or more intense shades of pink). The greatest number of colors (including all shades of blue, yellow, green, violet, and white, as well as some cooler or softer shades of pink) produced by filling with another inert gas, argon, and a drop of mercury (Hg) which is added to the tube immediately after purification. Each gas used in neon lights has its own color. Neon is red, helium is orange, argon is lavender, krypton is gray or green, mercury vapor is light blue, and xenon is gray or blue. Mixing gases and elements added to a neon light creates different hues. When the tube is ionized by electrification, the mercury evaporates into mercury vapor, which fills the tube and produces strong ultraviolet light. The ultraviolet light thus produced excites the various phosphor coatings designed to produce different colors. Even though this class of neon tubes use no neon at all, they are still denoted as "neon." Mercury-bearing lamps are a type of cold-cathode fluorescent lamps.

Each type of neon tubing produces two different possible colors, one with neon gas and the other with argon/mercury. Some "neon" tubes are made without phosphor coatings for some of the colors. Clear tubing filled with neon gas produces the ubiquitous yellowish orange color with the interior plasma column clearly visible, and is the cheapest and simplest tube to make. Traditional neon glasses in America over 20 years old are lead glass that are easy to soften in gas fires, but recent environmental and health concerns of the workers has prompted manufacturers to seek more environmentally safe special soft glass formulas. One of the vexing problems avoided this way is lead glass' tendency to burn into a black spot emitting lead fumes in a bending flame too rich in the fuel/oxygen mixture. Another traditional line of glasses was colored soda lime glasses coming in a myriad of glass color choices, which produce the highest quality, most hypnotically vibrant and saturated hues. Still more color choices are afforded in either coating, or not coating, these colored glasses with the various available exotic phosphors.

SUMMARY

A light assembly is disclosed that is formed of a carbon nanotube having an electrode inserted in each end. The electrodes form a gaseous seal with the carbon nanotube at each end of the carbon nanotube. A gas is sealed within the carbon nanotube by the electrodes. The gas emits light through the carbon nanotube when voltage is applied across said electrodes. The gas may be neon, argon, helium, xenon, krypton, hydrogen and carbon dioxide. The light assembly may also include a ring of sealant bonding the ends of the carbon nanotube to the electrodes to form the gas seal. The ring of sealant is applied over exterior surfaces of the electrodes and the carbon nanotube. The ring of sealant may be formed of an adhesive such as an epoxy or cyanoacrylate (aka "Super Glue"). The ring of sealant may also be formed of a glass. Alternatively, the light assembly may include a pair of end surfaces bonding each electrode to each end of the carbon nanotube, thereby sealing the gas within the carbon nanotube. These end surfaces may be formed of graphene, an adhesive, or a glass. The light assembly may also include a scaffolding to support the carbon nanotube and hold it in a desired shape. This scaffolding may include a frame having a patterned array of posts where the carbon nanotube is shaped and attached to the patterned array of posts to form a desired light-emitting shape. Alternatively, the carbon nanotube may be supported and placed into a desired shape by bonding it to a substrate with bonding pads. The substrate may be made of a glass, semiconductor, plastic, paper, graphene, carbon fiber composite, carbon fiber, or other composite material. The light assembly may also include a controller configured to regulate the electrical operation of the light assembly. The controller is electrically connected to the electrodes. It is desirable that the carbon nanotube be made of a semiconducting carbon nanotube.

A gas light source is disclosed that is formed of a graphene cylinder having an electrode inserted in each end where the electrodes form a gaseous seal with the graphene cylinder at each end of the graphene cylinder. A gas is sealed within the graphene cylinder by the electrodes. The gas emits light through the graphene cylinder when voltage is applied across the electrodes. The gas may be neon, argon, helium, xenon, krypton, hydrogen or carbon dioxide. The gas light source may also include a ring of sealant bonding the ends of the graphene cylinder to the electrodes. The ring of sealant may be applied over exterior surfaces of the electrodes and the graphene cylinder. The ring of sealant may be formed of an adhesive such as an epoxy or cyanoacrylate. The ring of sealant may also be formed of a glass. Alternatively, the light source may include a pair of end surfaces bonding each electrode to each end of the graphene cylinder, thereby sealing the gas within the graphene cylinder. These end surfaces may be formed of graphene, an adhesive, or a glass. The light source may further include a scaffolding to support the light source and hold it into a desired shape. This scaffolding may include a substrate formed of glass, semiconductor, plastic, paper, graphene, carbon fiber, or composite material and bonding pads attaching the graphene cylinder to the substrate and holding it into a visually desired shape. It is desirable that the graphene cylinder be made of a semiconducting carbon nanotube.

A seven-segment display is disclosed that includes seven light sources made of graphene cylinders arranged in the pattern of a figure eight in which each light source may be activated and lit independently in order to create various alpha-numeric symbols. The seven light sources are mounted into a component housing. An additional light source is attached to the component housing to serve as a decimal point. A processor controller activates the individual light sources to produce various alpha-numeric symbols. An RGB pixel is disclosed that is formed of three light sources made of graphene cylinders, each filled with a different gas that emits either red, green, or blue light. A processor controller is electrically coupled to the RGB pixel to pulse-width modulate the various graphene cylinder light sources to produce different desired colors and time dependent light color patterns. A display is disclosed that is formed of arrays of RGB pixels 40. These RGB pixels are operated by a grid of electrodes insulated by dielectric layers. A processor controller regulates the operation of the array of RGB pixels through pulse-width modulation to produce different desired colors and time dependent light color patterns at different levels of brightness. The front and back panels of this display are made of glass allowing light emitting from the array of RGB pixels to pass through. A nano-gas light lamp is disclosed that is formed of a graphene capsule. A pair of electrodes extend into the capsule and are bonded and sealed in place with a plug. The graphene capsule contains a gas that emits light when it is stimulated by an electric voltage.

BRIEF DESCRIPTION OF THE DRAWINGS

The novel features that are considered characteristic of the invention are set forth with particularity in the appended claims. The invention itself; however, both as to its structure and operation together with the additional objects and advantages thereof are best understood through the following description of the preferred embodiment of the present invention when read in conjunction with the accompanying drawings, wherein:

DETAILED DESCRIPTION

Figure 1:
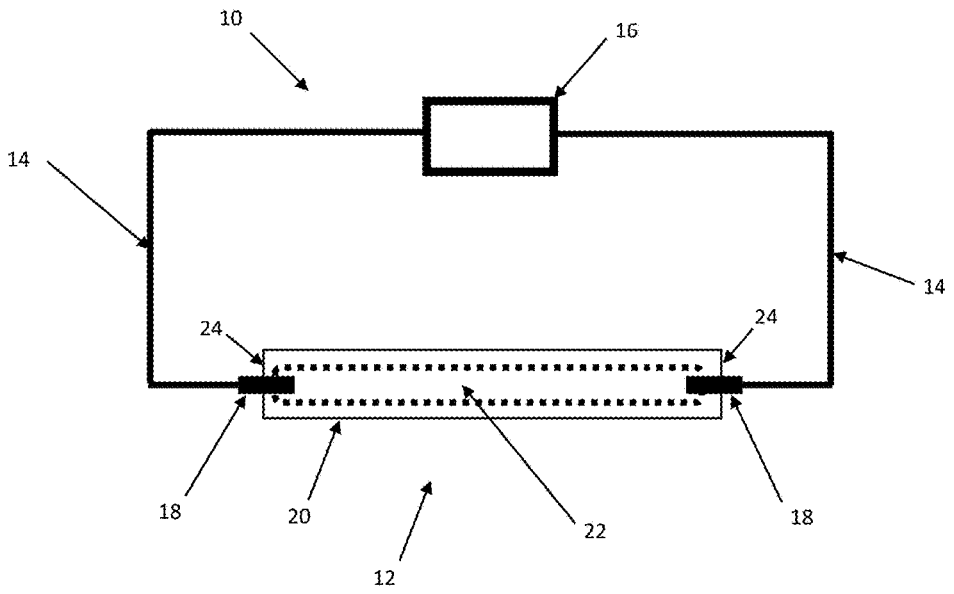
FIG. 1 illustrates a diagram of a nano-gas light source.

FIG. 1 illustrates a diagram of a nano-gas light source 10. Light source 10 includes a gas light tube assembly 12 that is coupled with wires 14 to a controller and power source 16. Controller regulates that function of gas light tube assembly 12 by controlling the electrical power provided to assembly 12. Gas light tube assembly 12 includes a pair of electrodes 18 that are bonded to a graphene cylinder 20. Graphene cylinder 20 may also be a carbon nanotube. Graphene cylinders and carbon nanotubes are both made of an atomically contiguous lattice of covalently-bonded carbon atoms. The difference between graphene cylinders and carbon nanotubes is the size of the diameter of the cylinder/tube. Typically, carbon nanotubes have an internal diameter that ranges from 0.5 nm to 15 nm. However, carbon nanotubes may also have an internal diameter that ranges up to 50 nm. Although made of the same material, graphene cylinders typically refer to a range of tubes made of graphene that have a larger diameter ranging from 50 nm-500 nm.

Graphene is a hexagonal lattice of carbon atoms that form an atomically contiguous sheet. Graphene is formed of an atomically contiguous lattice of covalently-bonded carbon atoms. Graphene sheet, also referred to as a graphene lattice, is a flat monolayer of carbon atoms that are tightly packed into a two-dimensional lattice. Graphene is 97.7% optically transparent. Graphene is an extremely strong material due to the covalent carbon-carbon bonds. It is desirable to utilize graphene lattices that are defect free as the presence of defects reduces the strength of the graphene lattice. The intrinsic strength of a defect free sheet of graphene 100 is 42 N/m, making it one of the strongest materials known. The strength of graphene is comparable to the hardness of diamonds. Graphene is also a highly flexible material. Multiple monolayers of graphene sheet can be grown on top of each other to create a multi-layer graphene sheet. Graphene exhibits a wavelength dependent index of refraction.

Graphene is also an impermeable membrane to even the smallest atoms, thereby maintaining the atmosphere of a vacuum or gas within the graphene cladding 18. Although it is only one atom thick, an interesting property of graphene is its impermeability. Graphene's p-orbitals forms a dense, delocalized cloud that blocks the gap within its aromatic rings. This creates a repelling field, which does not allow even the smallest molecules, like hydrogen and helium, to pass through even when 1-5 atm pressure difference is imposed across its atomic thickness at room temperature. The ability to withstand such pressure differences (6 atm) in graphene is a result of its high strength (breaking strength=42 N/m) and Young's modulus (1 TPa), which retains the structural integrity of graphene. Thus, a graphene cylinder can maintain a core made of a vacuum or gas when each end of the graphene cylinder 18 is sealed. A further discussion on graphene's impermeability is provided in the following scientific article hereby incorporated by reference: Vikas, Berry. Impermeability of graphene and its applications. Carbon (2013), http://dx.doi.org/10.1016/j.carbon.2013.05.052.

Graphene cylinder 20 contains a gas 22. Gas 22 may be neon, argon, helium, xenon, krypton, hydrogen or carbon dioxide. Electrodes 18 are bonded to each end of graphene cylinder 20 to form a gaseous seal with graphene cylinder 20, thereby holding gas 22 within gas light tube assembly 12 regardless of the atmosphere external to gas light tube assembly 12 due to the gaseous impermeability of graphene cylinder 20, electrodes 18, and the gaseous seal formed between graphene cylinder 20 and electrodes 18. Gas 22 is contained within gas light tube assembly under a particular pressure range. This pressure range may be 2-5 Torr, 5-10 Torr, 10-15 Torr, or 15-20 Torr.

Carbon nanotubes can be conducting or semiconducting. The diameter of a carbon nanotube and the amount of twist in its lattice determines whether it's metallic or semiconducting. Electrons in carbon nanotubes can only be at certain energy levels, just like electrons in atoms. A nanotube is metallic if the energy level that allows delocalized electrons to flow between atoms throughout the nanotube (referred to as the conduction band) is right above the energy level used by electrons attached to atoms (the valance band). In a metallic nanotube, electrons can easily move to the conduction band. A nanotube is semiconducting if the energy level of the conduction band is high enough so that there is an energy gap between it and the valance band. In this case, additional energy, such as light, is needed for an electron to jump that gap to move to the conduction band. While there is no gap between the valance and conduction bands for armchair nanotubes (which makes them metallic), an energy gap does exist between the valance and conduction bands in about two thirds of zigzag and chiral nanotubes—which makes them semiconducting. Conducting carbon nanotubes act as one-dimensional nanowires. Semiconducting carbon nanotubes are basically non-conducting, have small dielectric constants, medium to large band gaps and hence can act as insulating shields to electric fields generated by electrodes 18. It is desirable to make graphene cylinder 20 out of a semiconducting carbon nanotube. With semiconducting carbon nanotubes, electrodes 18 generate an electric field that causes gas 22 to discharge photons that are emitted through graphene cylinder 20 outward to the external environment creating a light source.

Graphene cylinder 20 may have end surfaces 24 that form a gaseous seal with electrodes 18 bonding electrodes 18 to graphene cylinder 20. These end surfaces 24 may be made out of a variety of materials that function to bond electrodes 18 to cylinder 20 and form a gaseous seal to keep gas 22 contained entirely within assembly 12. End surfaces 24 may be made of an adhesive. Such an adhesive could include, but is not limited to, an epoxy and cyanoacrylate. Other materials for end surfaces can include a glass, graphene, or composite material.

Controller power source 16 controls the operation of light source 10. For example, controller 16 may turn light source 10 ON and OFF. In addition, controller 16 may operate light source 10 with a Pulse Width Modulated (PWM) voltage in order to create the desired light with a reduced amount of power usage. It is possible to vary the brightness of light source 10 with PWM. Controller 16 may further control light source 10 to operate to produce various time dependent patterns of light, such as a blinking light that varies in the speed and duration at which it blinks. Electrodes 18 may be made of a metal. Electrodes 18 may take the form of a metal nanowire. Alternatively, electrodes 18 may be formed of conducting carbon nanotubes. A starting voltage (usually 55-110 volts AC, or 90-140 volts DC) is applied, the gas ionizes and starts to glow permitting a very small current to travel from one electrode to the other. Once ionized, a lower voltage will maintain the operation of the light source 10. The maintaining voltage is usually 10-20 volts below the starting voltage, depending on the light source 12 and the operating current. For light source 10 operating on AC voltages of 60 Hz or higher frequency, the light output will appear to the eye as continuous.

Figure 2:
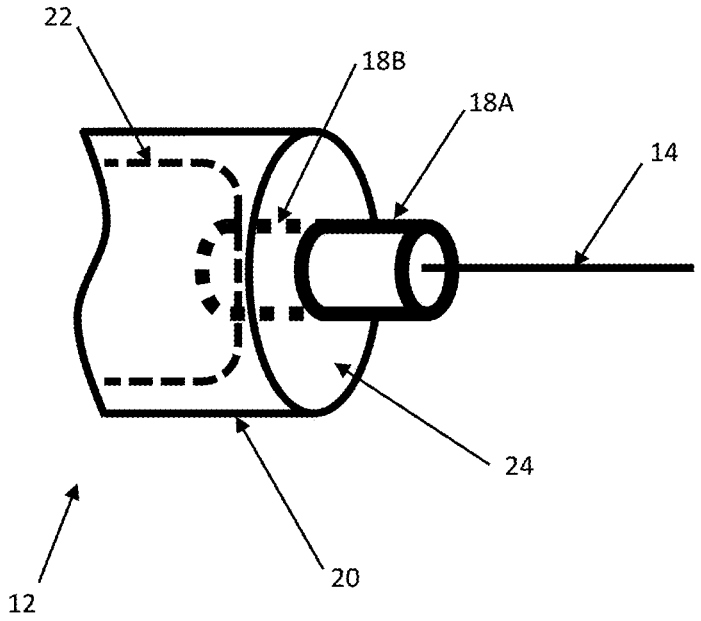
FIG. 2 illustrates a perspective view of one end of a graphene cylinder having an electrode inserted therein and an end surface forming a gaseous seal.

FIG. 2 illustrates a perspective view of one end of a graphene cylinder 20 having an electrode 18 inserted therein and an end surface 24 forming a gaseous seal. Wire 14 electrically connects electrode 18 to controller power source 16. Graphene cylinder 20 and end surface 24 form a gaseous capsule that, together with electrode 18, maintain gas 22 within assembly 12 regardless of the ambient atmosphere external to assembly 12. Electrode 18 includes an exterior portion 18A that extends outside of the capsule formed by graphene cylinder 20 and end surface 24. Electrode 18 also includes an interior portion 18B that extending inside of the capsule formed by graphene cylinder 20 and end surface 24. These end surfaces 24 may be made out of a variety of materials that function to bond electrodes 18 to cylinder 20 and form a gaseous seal to keep gas 22 contained entirely within assembly 12. End surfaces 24 may be made of an adhesive. Such an adhesive could include, but is not limited to, an epoxy and cyanoacrylate. Other materials for end surfaces can include a glass, graphene, or composite material. In the embodiment illustrated in FIG. 2, electrodes 18 have an external diameter that is smaller than the internal diameter of graphene cylinder 20, thereby requiring the presence of end surfaces 24 to bridge the gap between them to bond them together and form the gaseous seal.

Figure 3:
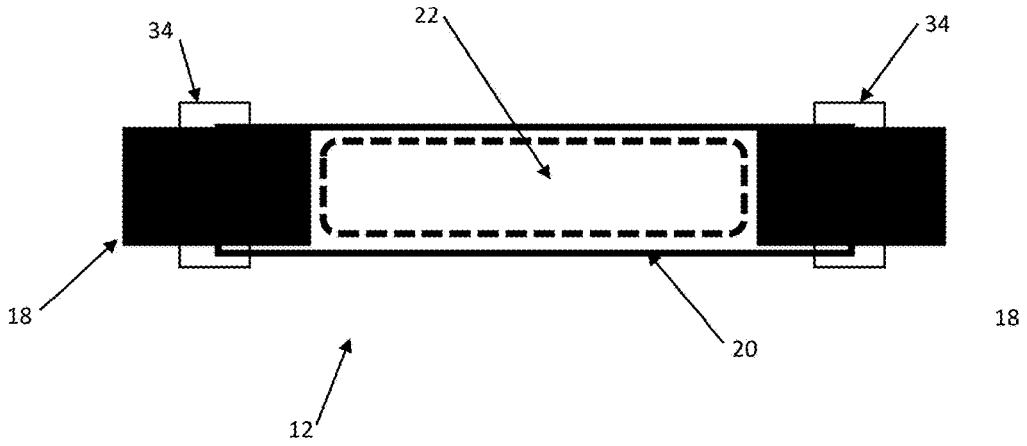
FIG. 3 illustrates a cutaway side view of a nano-gas light source where the electrodes fill the end openings of the graphene cylinder and a gas seal is formed by material covering around both the ends of the graphene cylinder and the electrodes.

FIG. 3 illustrates a cutaway side view of a nano-gas light source where the electrodes 18 fill the end openings of the graphene cylinder 20 and a gas seal is formed by material 34 covering around both the ends of the graphene cylinder 20 and the electrodes 18. In this embodiment, the outer diameter of electrodes 18 is just smaller than the inner diameter of graphene cylinder 20. Thus, due to these respective diameters, electrodes 18 can slide into the ends of graphene cylinder 20 and form a gaseous seal without the need for the end surfaces 24 depicted in FIG. 2. Electrodes 18 are made of a metal. Electrodes 18 are bonded to graphene cylinder 20 by gas sealing rings 34. Gas sealing rings 34 go around the entire exterior circumference of both graphene cylinder 20 and electrode 18, thereby bonding them together and forming a gaseous seal that keeps gas 22 contained within assembly 12 under pressure regardless of the atmosphere external to assembly 12. Gas seal rings 34 may be made of any material that bonds metal electrodes 18 to graphene cylinder 20 and forms a gas tight seal to prevent gas 22 from escaping assembly 12. Materials for gas sealing rings 34 can include an adhesive such as epoxy or cyanoacrylate. Gas sealing rings may be also made of a glass, graphene, or composite material.

Figure 4:
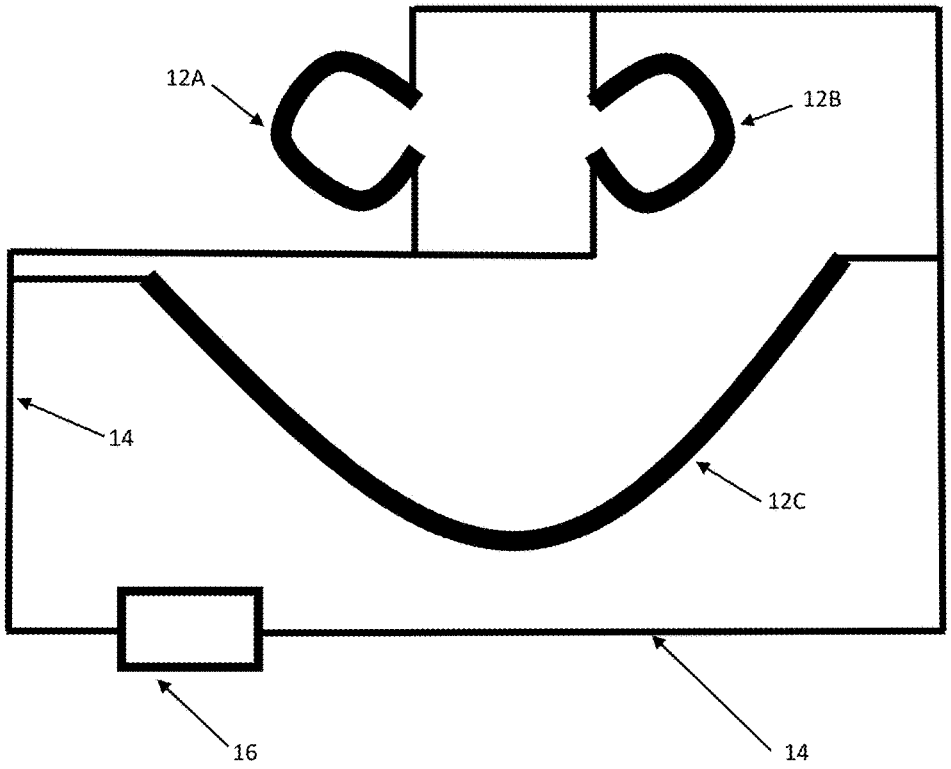
FIG. 4 illustrates a wiring diagram of three nano-gas light sources formed into a "smiley face" shape that are connected to a control circuit and power source.

FIG. 4 illustrates a wiring diagram of three nano-gas light sources 12 formed into a "smiley face" shape that are connected to a control circuit and power source 16. In order to create a desired visual icon or image, multiple light sources 12 may be formed and used and connected into an electrical circuit. Here, light sources 12A and 12B are shaped into a "C" configuration to form left and right eyes. Light source 12C is formed into a large smile. The combination of light sources 12A, 12B and 12C is to create the image or icon of a smiling face. Wires 14 couple the various electrodes of light sources 12A, 12B and 12C to the terminals of controller-power source 16. In this circuit configuration, light assemblies 12A, 12B and 12C are all connected in parallel to controller-power source 16. As light sources 12A, 12B and 12C are all separate components, they may each be filled with a different gas to emit a different color of light. For example, the eyes formed of light sources 12A and 12B may be formed of one gas 22 to emit one color of light, such as argon/mercury for blue eyes, and neon for bright red lips for a smile. In a parallel configuration, controller 16 operates light sources 12A, 12B, and 12C together as one single light source. The wiring configuration shown in FIG. 4 is merely an exemplary one. Light sources 12A, 12B and 12C for example may all be connected independently to controller 16 so that controller can operate each light source independently. For example, light sources 12A and 12C could be on continuously, but light source 12B, the right eye, could be operated to blink independently, thereby making the smiley face to have the appearance that it is winking.

Figure 5:
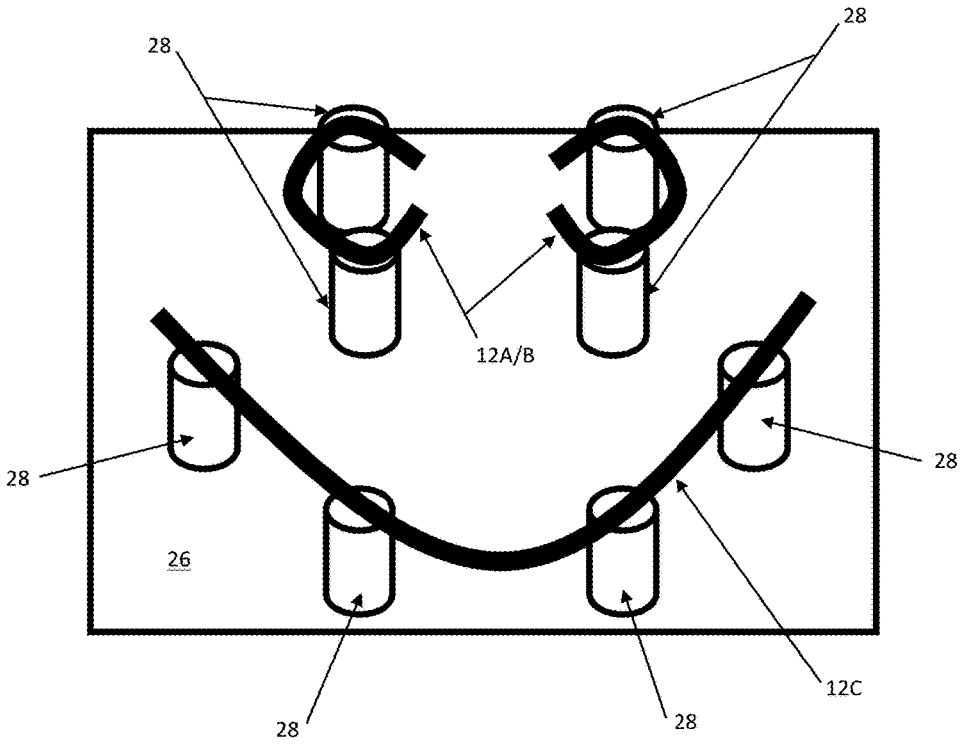
FIG. 5 illustrates a diagram of a frame having a patterned array of posts that are attached to a shaped light assembly in order to create a desired light emitting shape.

FIG. 5 illustrates a diagram of a frame 26 having a patterned array of posts 28 that are attached to a shaped lighting assembly 12A, 12B and 12C in order to create a desired light emitting shape, which in this case is a smiling face. Frame 26 may be formed of any rigid or semi rigid material, such as for example, a metal, plastic, glass, carbon fiber, carbon fiber composite, paper, cardboard, or other composite material. Posts 28 are bonded or otherwise attached to frame 26. Frame 26 is shown as a rectangular substrate, but may take the form of a wire scaffolding to create any desired three-dimensional shape. Posts 28 are arranged into a desired pattern to form an image or icon. Shaping the light assemblies 12 into a pattern to fit and attach to posts 28 creates the desired lighted image or icon when controller and power assembly 16 operates light assemblies 12 to emit light. In order to create an electrically operational light source 10, the electrical circuit of FIG. 4 is combined with the mechanical structure of FIG. 5. The mechanical structure, i.e. scaffolding of frame 26 and posts 28 bonded to light assemblies 12 is shown in a separate figure from the wiring configuration of light assemblies 12 to controller power source 16 with wires 14 for ease of illustration. A desired light source 10 would include both the wiring of FIG. 4 and structure of FIG. 5.

Figure 6:
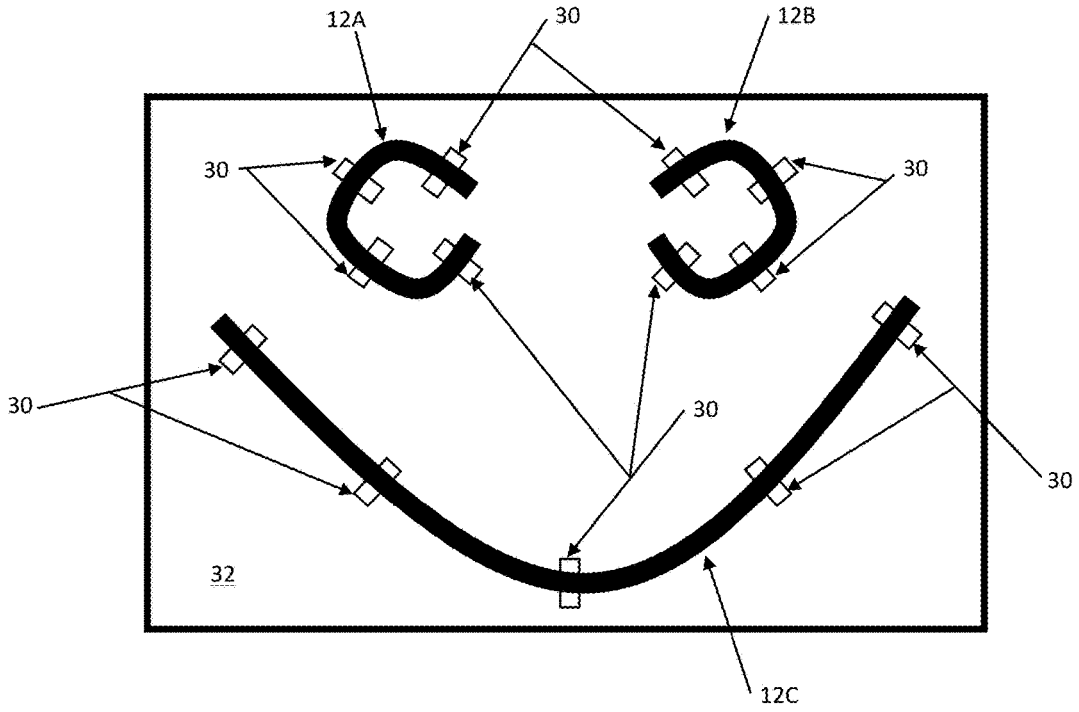
FIG. 6 illustrates a diagram of a substrate having a patterned array of bonding pads that attach a light assembly to the substrate into a desired light emitting shape.

FIG. 6 illustrates a diagram of a substrate 32 having a patterned array of bonding pads 30 that attach light assemblies 12A, 12B and 12C to the substrate 32 into a desired light emitting shape, which in this case is a smiley face. Substrate 32 may be made of a rigid material, a flexible material, or a semi-flexible material. For example, substrate 32 may be formed of a metal, a glass, a plastic, paper, graphene, cardboard, carbon fiber, fabric, a carbon fiber composite, or other material. Bonding pads 30 are a material that attaches light assemblies 12A, 12B and 12C to substrate 32. These bonding pads may be formed of an adhesive such as epoxy or cyanoacrylate (aka "Super Glue"). The adhesive may also take the form of a sticky tape, hot glue, or other means of attachment. For example, bonding pads could use any means of attaching light sources 12A, 12B and 12C to substrate 30.

Figure 7:
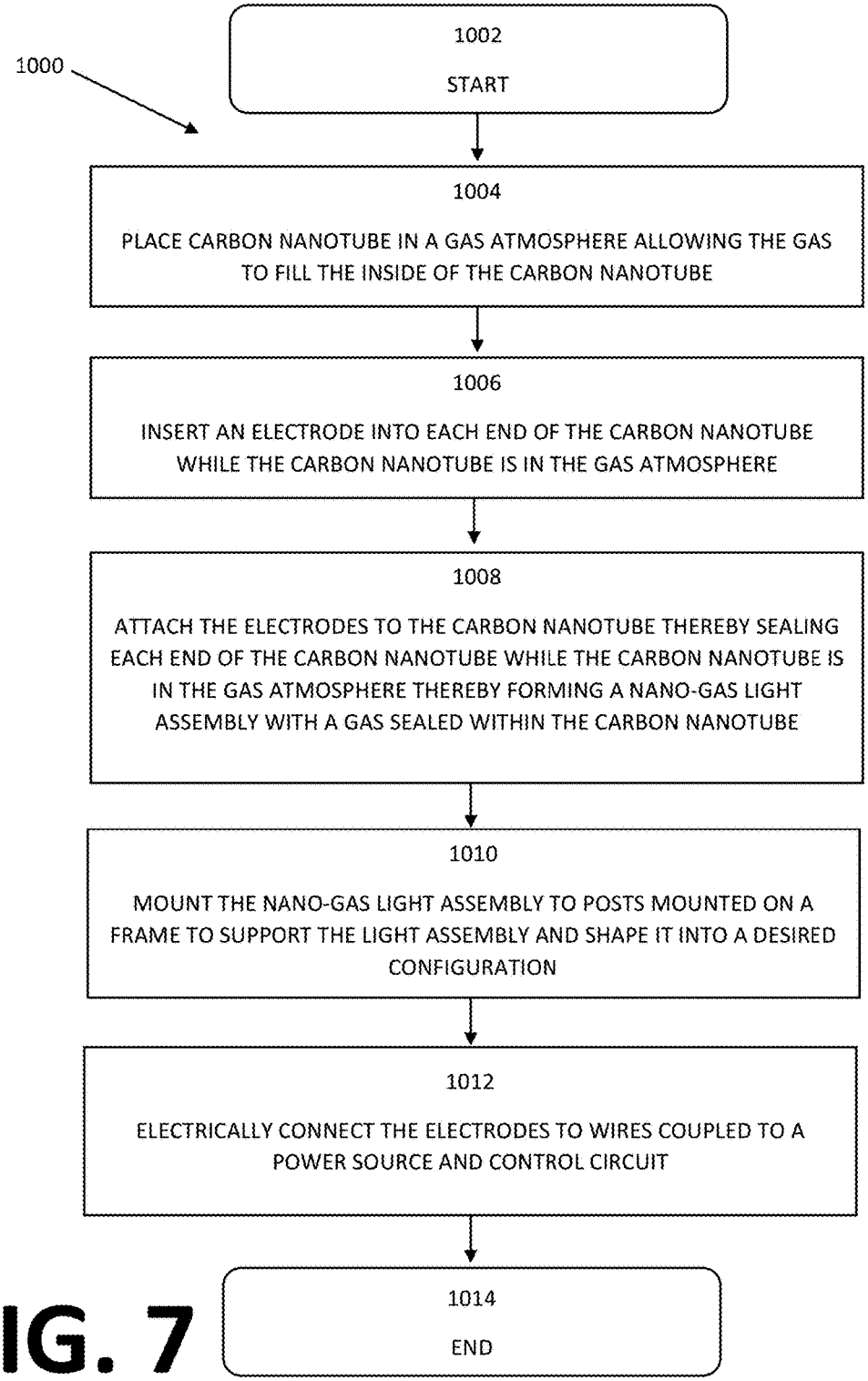
FIG. 7 depicts a flow chart that illustrates a method of manufacturing a nano-noble gas light emitting source that includes a graphene cylinder.

FIG. 7 depicts a flow chart 1000 that illustrates a method of manufacturing a nano-gas light emitting source 12 that includes a graphene cylinder 20. Flow chart 1000 begins with process step START in 1002. In step 1004, a graphene cylinder 20 or carbon nanotube 20 is placed in a gas atmosphere allowing the gas 22 to fill the inside of the graphene cylinder 20. In step 1006, electrodes 18 are inserted into each end of the carbon nanotube 20 or graphene cylinder 20 while the graphene cylinder is in the gas atmosphere. In step 1008, the electrodes 18 are attached/bonded to the ends of graphene cylinder 20, thereby forming a gas tight seal between the graphene cylinder 20 and the electrodes 18. As a consequence of creating this gas tight seal, the gas 22 present within graphene cylinder 20 are permanently sealed within the capsule formed by graphene cylinder 20 and electrodes 18. Thus, the capsule formed by graphene cylinder 20 and electrodes 18 maintains gas 22 within the capsule regardless of the atmosphere external to the capsule. In step 1010, the nano-gas light assembly 12 mounts to posts 28 or bonding pads 30 to secure assembly 12 to a frame 26 or substrate 32. In this process, the posts 28 or bonding pads 30 are arranged in a pattern to hold assemblies 12 into a desired configuration to create a desired image or icon when light assemblies 12 are turned on by controller power source 16.

A light assembly is disclosed that is formed of a carbon nanotube 20 having an electrode 18 inserted in each end. The electrodes 18 form a gaseous seal with the carbon nanotube 20 at each end of the carbon nanotube 20. A gas 22 is sealed within the carbon nanotube 20 by the electrodes 18. The gas 22 emits light through the carbon nanotube 20 when voltage is applied across said electrodes 18. The gas 22 may be neon, argon, helium, xenon, krypton, hydrogen and carbon dioxide. The light assembly 12 may also include a ring of sealant 34 bonding the ends of the carbon nanotube 20 to the electrodes 19 to form the gas seal. The ring of sealant 34 is applied over exterior surfaces of the electrodes 18 and the carbon nanotube 20. The ring of sealant 34 may be formed of an adhesive such as an epoxy or cyanoacrylate (aka "Super Glue"). The ring of sealant 34 may also be formed of a glass. Alternatively, the light assembly 12 may include a pair of end surfaces 24 bonding each electrode 18 to each end of the carbon nanotube 20, thereby sealing the gas 22 within the carbon nanotube 20. These end surfaces 24 may be formed of graphene, an adhesive, or a glass. The light assembly 12 may also include a scaffolding to support the carbon nanotube 20 and hold it in a desired shape. This scaffolding may include a frame 26 having a patterned array of posts 28 where the carbon nanotube 20 is shaped and attached to the patterned array of posts 28 to form a desired light-emitting shape. Alternatively, the carbon nanotube 20 may be supported and placed into a desired shape by bonding it to a substrate 32 with bonding pads 30. The substrate 32 may be made of a glass, semiconductor, plastic, paper, graphene, carbon fiber composite, carbon fiber, or other composite material. The light assembly may also include a controller 16 configured to regulate the electrical operation of the light assembly. The controller 16 is electrically connected to the electrodes 18. It is desirable that the carbon nanotube 20 be made of a semiconducting carbon nanotube.

A gas light source 10 is disclosed that is formed of a graphene cylinder 20 having an electrode 18 inserted in each end where the electrodes 18 form a gaseous seal with the graphene cylinder 20 at each end of the graphene cylinder 20. A gas 22 is sealed within the graphene cylinder 20 by the electrodes 18. The gas 22 emits light through the graphene cylinder 20 when voltage is applied across the electrodes 18. The gas 22 may be neon, argon, helium, xenon, krypton, hydrogen or carbon dioxide. The gas light source 12 may also include a ring of sealant 34 bonding the ends of the graphene cylinder 20 to the electrodes 18. The ring of sealant 34 may be applied over exterior surfaces of the electrodes 18 and the graphene cylinder 20. The ring of sealant 34 may be formed of an adhesive such as an epoxy or cyanoacrylate. The ring of sealant 34 may also be formed of a glass. Alternatively, the light source may include a pair of end surfaces 24 bonding each electrode 18 to each end of the graphene cylinder 20, thereby sealing the gas 22 within the graphene cylinder 20. These end surfaces 24 may be formed of graphene, an adhesive, or a glass. The light source 12 may further include a scaffolding to support the light source 12 and hold it into a desired shape. This scaffolding may include a substrate 32 formed of glass, semiconductor, plastic, paper, graphene, carbon fiber, or composite material and bonding pads 30 attaching the graphene cylinder 20 to the substrate 32 and holding it into a visually desired shape. It is desirable that the graphene cylinder 20 be made of a semiconducting carbon nanotube.

Figure 8:
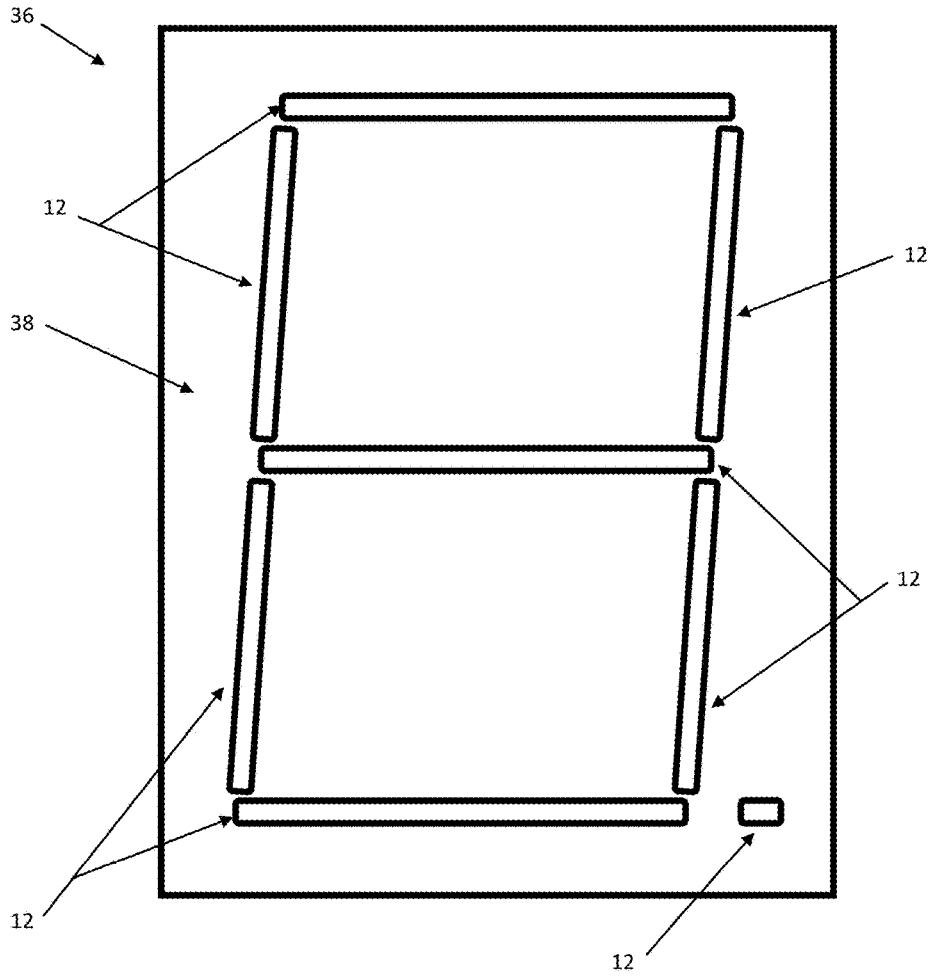
FIG. 8 illustrates a seven-segment display formed of seven nano-gas light sources for the number and one nano-gas light source for the decimal point.

FIG. 8 illustrates a seven-segment display 36 formed of seven nano-gas light sources 12 for the number and one nano-gas light source 12 for the decimal point. A seven-segment display (SSD), or seven-segment indicator, is a form of electronic display device for displaying decimal numerals that is an alternative to the more complex dot matrix displays. Seven-segment displays are widely used in digital clocks, electronic meters, basic calculators, and other electronic devices that display numerical information. Seven nano-gas light sources 12 are mounted to component housing 38 in the form of a number 8, as illustrated in FIG. 8, common for seven-segment displays 36. The circuitry that wires the seven-segment display 36 for operation of the nano-gas light sources 12 is contained within component housing 38. One nano-gas light source 12 is mounted to component housing 38 as a decimal point. Each light source 12 may be lit independently of the others and in any combination in order to create various lit alpha-numeric symbols. Light sources 12 are light in various combinations to create different lit alpha-numeric symbols through use of an electrically coupled controller processor.

Figure 9:
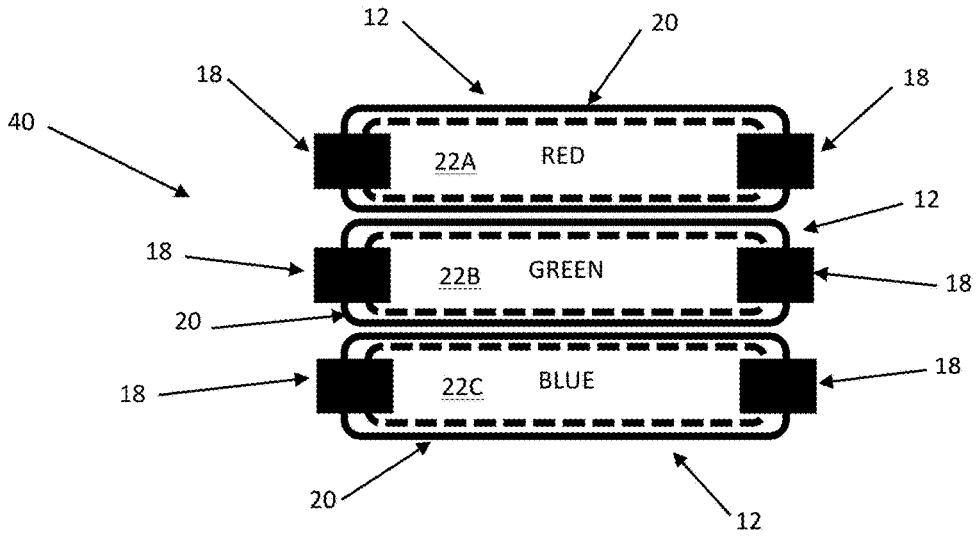
FIG. 9 illustrates an RGB pixel formed of three nano-gas light sources filled with different gases to emit light in colors of Red, Green and BLUE.

FIG. 9 illustrates an RGB pixel 40 formed of three nano-gas light sources 12 filled with different gases 22A, 22B and 22C to emit light in colors of red, green and Blue. The RGB color model is an additive color model in which red, green and blue light are added together in various ways to reproduce a broad array of colors. The name of the model comes from the initials of the three additive primary colors, red, green, and blue. RGB pixel 40 is formed of three nano-gas light sources 12 filled with a different color light producing gas. Each gas used in neon lights has its own color. Neon is red, helium is orange, argon is lavender, krypton is gray or green, mercury vapor is light blue, and xenon is gray or blue. Mixing gases and elements added to a neon light creates different hues. Here, one of the light sources is filled with neon gas 22A for red, krypton gas 22B for green, and mercury vapor 22C for blue. It is possible to vary and tune the shades of these colors by mixing other gases 22 in with them. To form a color with RGB pixel 40, the three light beams emitted from gases 22A, 22B and 22C (one red, one green, and one blue) are superimposed. Each of the three beams of light emitted from gasses 22A, 22B and 22C is called a component of that color, and each of them can have an arbitrary intensity, from fully off to fully on, in the mixture. The RGB color model is additive in the sense that the three light beams emitted from gases 22A, 22B and 22C are added together, and their light spectra add, wavelength for wavelength, to make the final color's spectrum. Arrays of RGB pixels 40 can be used to create various sized displays on electronic devices such as mobile phones, tablets, mobile laptop computers, desktop computers, televisions, and large stadium RGB displays. Each light source 12 includes a graphene tube 20, electrodes 18, and an internally contained gas 22. Brightness of pixel 40 is varied using Pulse-Width Modulation (PWM). A processor-controller coupled to RGB pixel 40 controls the operation of pixel 40 to produce various produce different desired colors and time dependent light color patterns at various brightness.

Figure 10:
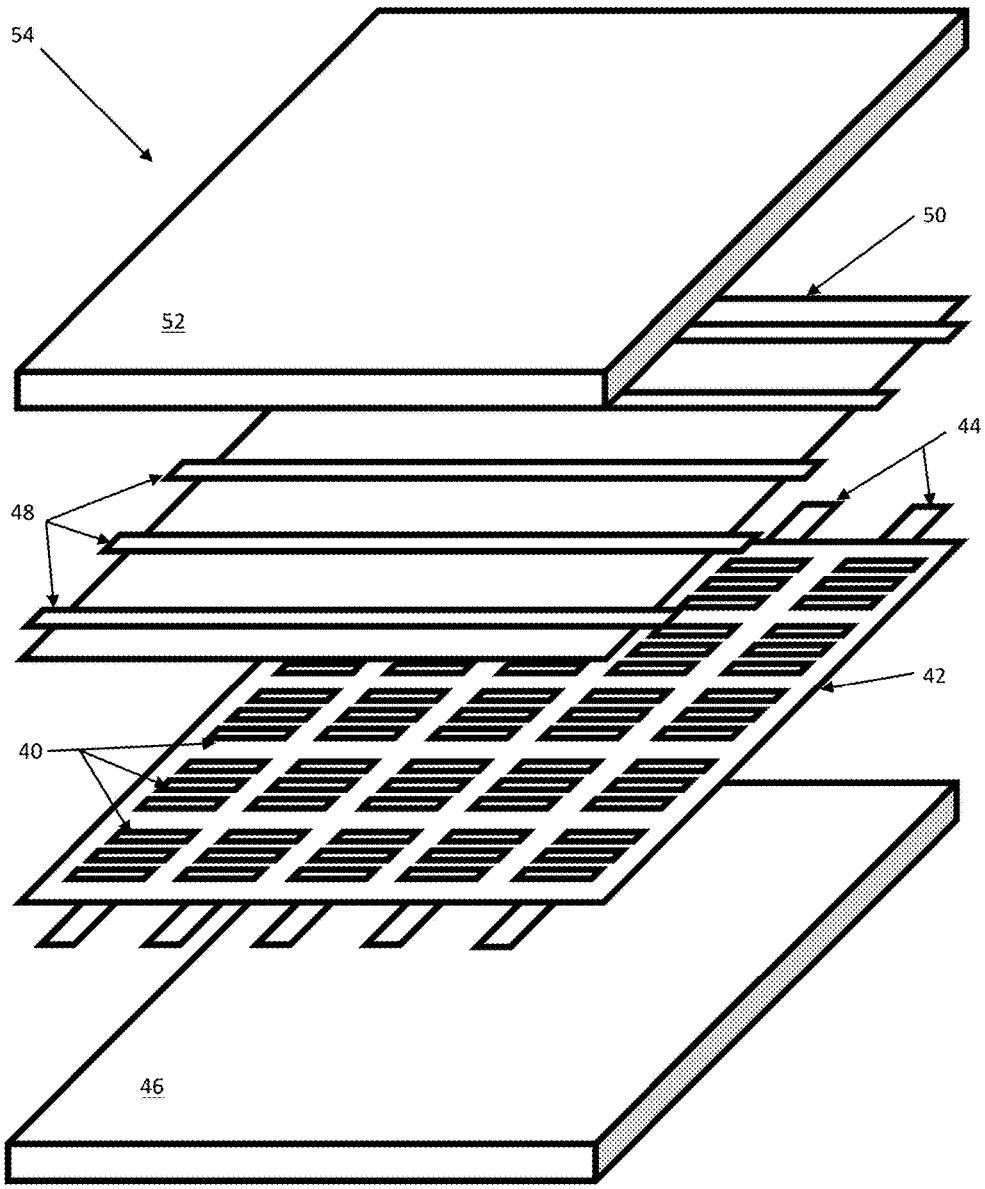
FIG. 10 illustrates an exploded view of a display formed of an array of pixels made of three nano-gas light sources.

FIG. 10 illustrates an exploded view of a display 54 formed of an array of RGB pixels 40 made of three nano-gas light sources 12. Display 54 includes a bottom glass substrate 46. An array of RGB pixels 40 are placed on dielectric layer 42. Individual RGB pixels 40 are activated utilizing a combination of display electrodes 44 and address electrodes 48. A processor control device activates individual pixels 40 using electrodes 44 and 48. Address electrodes 48 are mounted on dielectric layer 50. A top glass substrate 52 covers the assembly. The brightness of pixels 40 is varied using Pulse-Width Modulation (PWM) as directed by the processor controller. The display 54 can be formed of any size to be used for mobile phones, tablets, mobile laptop computers, desktop computers, televisions, and large stadium RGB displays. The processor controller activates pixels 40 in particular time dependent patterns to recreate moving images for viewing purposes. Dielectric layers 42 and 50 are provided to electrically insulate electrodes 44 and 48. Dielectric layers 42 and 50 are also used to planarize the layers with electrodes 44 and 48 to provide a flat surface for glass panels 46 and 52. The front and back panels 46 and 52 of this display 54 are made of glass allowing light emitting from the array of RGB pixels 40 to pass through for viewing by a viewer.

Figure 11:
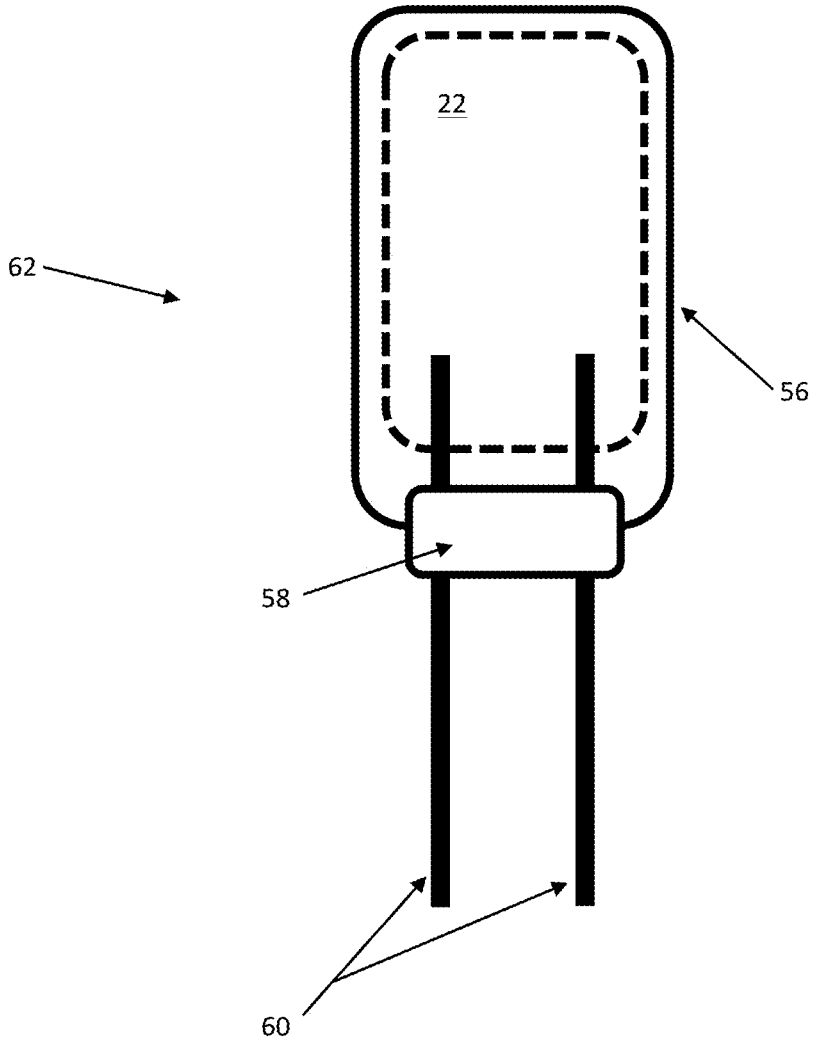
FIG. 11 illustrates a lamp formed of a graphene capsule filled with a gas that emits light when voltage is applied across electrodes.

FIG. 11 illustrates a lamp 62 formed of a graphene capsule 56 filled with a gas 22 that emits light when voltage is applied across electrodes 60. A plug 58 seals the bottom of capsule 56 and electrodes 60. Electrodes 60 are mounted within small graphene envelope 56. A starting voltage (usually 55-110 volts AC, or 90-140 volts DC) is applied, the gas ionizes and starts to glow permitting a very small current to travel from one electrode to the other. Once ionized, a lower voltage will maintain the operation of the lamp 62. The maintaining voltage is usually 10-20 volts below the starting voltage, depending on the lamp 62 and the operating current. For lamps 62 operating on AC voltages of 60 Hz or higher frequency, the light output will appear to the eye as continuous.

While the invention has been shown and described with reference to a particular embodiment thereof, it will be understood to those skilled in the art, that various changes in form and details may be made therein without departing from the spirit and scope of the invention.

The invention claimed is:

1. A light assembly, comprising:

a carbon nanotube having an electrode inserted in each end, wherein said electrodes form a gaseous seal with said carbon nanotube at each end of said carbon nanotube; and a gas sealed within said carbon nanotube by said electrodes, said gas emits light through said carbon nanotube when voltage is applied across said electrodes.

2. The light assembly of claim 1, wherein said gas is selected from the group consisting of neon, argon, helium, xenon, krypton, hydrogen and carbon dioxide, wherein said carbon nanotube is a semiconducting carbon nanotube.

3. The light assembly of claim 2, further comprising a ring of sealant bonding the ends of said carbon nanotube to said electrodes, wherein said ring of sealant is applied over exterior surfaces of said electrodes and said carbon nanotube.

4. The light assembly of claim 3, wherein said ring of sealant is formed of an adhesive selected from the group consisting of an epoxy and cyanoacrylate.

5. The light assembly of claim 3, wherein said ring of sealant is formed of a glass, graphene, or composite material.

6. The light assembly of claim 2, further comprising a pair of end surfaces bonding each electrode to each end of said carbon nanotube, thereby sealing said gas within said carbon nanotube.

7. The light assembly of claim 6, wherein said end surfaces are formed of graphene.

8. The light assembly of claim 6, wherein said end surfaces are formed of an adhesive.

9. The light assembly of claim 6, wherein said end surfaces are formed of a glass.

10. The light assembly of claim 3, further comprising:

a frame having a patterned array of posts, wherein said carbon nanotube is shaped and attached to said patterned array of posts to form a desired light-emitting shape; and a controller configured to regulate the electrical operation of said light assembly, wherein said controller is electrically connected to said electrodes.

11. A gas light source, comprising;

a graphene cylinder having an electrode inserted in each end, wherein said electrodes form a gaseous seal with said graphene cylinder at each end of said graphene cylinder; and a gas sealed within said graphene cylinder by said electrodes, said gas emits light through said graphene cylinder when voltage is applied across said electrodes.

12. The gas light source of claim 11, wherein said gas is selected from the group consisting of neon, argon, helium, xenon, krypton, hydrogen and carbon dioxide, wherein said graphene cylinder is a semiconducting graphene cylinder.

13. The gas light source of claim 12, further comprising a ring of sealant bonding the ends of graphene cylinder to said electrodes, wherein said ring of sealant is applied over exterior surfaces of said electrodes and said graphene cylinder.

14. The gas light source of claim 13, wherein said ring of sealant is formed of an adhesive selected from the group consisting of an epoxy and cyanoacrylate.

15. The gas light source of claim 13, wherein said ring of sealant is formed of a glass.

16. The gas light source of claim 12, further comprising a pair of end surfaces bonding each electrode to each end of said graphene cylinder, thereby sealing said gas within said graphene cylinder.

17. The gas light source of claim 16, wherein said end surfaces are formed of graphene.

18. The gas light source of claim 16, wherein said end surfaces are formed of an adhesive.

19. The gas light source of claim 16, wherein said end surfaces are formed of a glass.

20. The gas light source of claim 13, further comprising:

a substrate selected from the group consisting of glass, semiconductor, plastic, paper, graphene, carbon fiber-composite, carbon fiber, and composite material; and bonding pads attaching said graphene cylinder to said substrate.

* * * * *